United States Patent [19]

Kubodera et al.

[11] Patent Number: 4,886,775

[45] Date of Patent: Dec. 12, 1989

[54] HEAT TRANSFER DYE-RECEIVING SHEET

[75] Inventors: Seiiti Kubodera; Nobuhiko Minagawa, both of Kanagawa, Japan

[73] Assignee: Fuji Photo Film Co., Ltd., Kanagawa, Japan

[21] Appl. No.: 288,170

[22] Filed: Dec. 22, 1988

[30] Foreign Application Priority Data

Dec. 24, 1987 [JP] Japan ..... 62-327978

[51] Int. Cl.[4] ..... B41M 5/035; B41M 5/26

[52] U.S. Cl. ..... 503/227; 8/471; 428/195; 428/331; 428/335; 428/336; 428/447; 428/480; 428/913; 428/914

[58] Field of Search ..... 8/471; 428/480, 913, 428/914, 195, 331, 335, 336, 447; 503/227

[56] References Cited

U.S. PATENT DOCUMENTS 4,097,230 6/1978 Sandhu ..... 503/227

4,720,480 1/1988 Ito et al. ..... 503/227

*Primary Examiner*—Bruce H. Hess

*Attorney, Agent, or Firm*—Sughrue, Mion, Zinn, Macpeak & Seas

[57] ABSTRACT

A heat transfer dye-receiving sheet used in combination with a heat transfer sheet having a dye carrying layer containing a dye, said heat transfer dye-receiving sheet comprising a dye-receiving layer receiving the dye transferred from the heat transfer sheet, wherein the dye-receiving layer contains a polyester resin comprising bisphenol A, carbonic acid and phthalic acid.

10 Claims, No Drawings

HEAT TRANSFER DYE-RECEIVING SHEET

FIELD OF THE INVENTION

The present invention relates to a heat transfer dye-receiving sheet, and more particularly to a dye-receiving sheet which may be used in a heat-sensitive transfer recording system such as a system which comprises heating an ink layer provided on a heat transfer sheet to cause transferring of the ink to a dye-receiving sheet. That is, the present invention relates to a heat transfer dye-receiving sheet capable of recording signals such as image signals having excellent sharpness.

BACKGROUND OF THE INVENTION

With the recent rapid development of the information industry, various information processing systems have been developed, and recording methods and apparatuses suitable for each information processing system have been developed and implemented. In a heat-sensitive recording method, which is one of the above described recording systems, the apparatus used for practising the heat-sensitive recording method is light, small and noiseless, operation and maintenance of the apparatus are easy and color prints can easily be obtained. Therefore, the above heat-sensitive transfer recording method has gained widespread acceptance. This heat-sensitive transfer recording method is largely classified into two methods. The first is a method which comprises heating heat-fusible ink coated on a support from the support side to cause the ink to melt according to the patterns of image signals, and transferring the ink melted onto a heat transfer dye-receiving sheet to produce a hard copy. The second is a method which comprises heating heat transfer materials composed of resins having a high softening point and a sublimable dye coated on a support from the support side, subliming the sublimable dye according to the patterns made by image signals, and transferring the dye onto a heat transfer dye-receiving sheet to produce a hard copy.

However if the transferred dye does not firmly adhere on a dye-receiving layer, undesirable phenomenon occurs that the dye is incompletely transferred to the dye-receiving sheet.

If resins used in the dye-receiving layer of the heat transfer dye-receiving sheet are not proper, durability of images is not good.

Heretofore, various approaches have been made to more completely transfer a dye to a dye-receiving sheet and to improve durability of images, but a satisfactory approach has not yet been found.

SUMMARY OF THE INVENTION

An object of the present invention is to provide a heat transfer dye-receiving sheet capable of providing high definition images having high sharpness and excellent durability.

The above and other objects and effects of the present invention will be apparent from the following description.

The above objects of the present invention can be attained by a heat transfer dye-receiving sheet used in combination with a heat transfer sheet having a dye carrying layer containing a heat transfer dye, the heat transfer dye-receiving sheet comprising a dye-receiving layer capable of receiving the dye transferred from the heat transfer sheet, wherein the dye-receiving layer contains a polyester resin comprising bisphenol A, carbonic acid and phthalic acid.

DETAILED DESCRIPTION OF THE INVENTION

The present invention will now be illustrated in more detail.

The dye-receiving layer may be provided on a sheet-shaped support.

The support sheet for use in the heat transfer dye-receiving sheet of the present invention may be comprised of any materials conventionally employed in the art, and examples thereof include (1) synthetic paper (polyolefin type paper, polystyrene type paper); (2) high quality paper, art paper, coated paper, castcoat paper, wall paper, paper for lining, synthetic resin or emulsion impregnated paper, synthetic rubber latex impregnated paper, synthetic resin contained paper, paperboard, cellulose fiber paper; and (3) a film or a sheet of various plastics such as polyolefin, polyvinyl chloride, polyethylene terephthalate, polystyrene, methacrylate or polycarbonate.

Also, a laminate comprising a composite of any of (1) to (3) above can be used. Typical examples of the laminates include a laminate of cellulose fiber paper and synthetic paper and a laminate of cellulose fiber paper and a plastic film or sheet.

As further examples of the laminates, a plastic film can be used with synthetic paper instead of cellulose fiber paper. Further, a laminate of cellulose fiber paper, plastic film and synthetic paper can be also used.

The support sheet serves to support the dye receiving layer, and it is desirable that the support sheet have mechanical strength sufficient enough to handle the dye-receiving sheet which is heated at the time of heat transfer recording.

If the dye-receiving layer alone has the necessary mechanical strength, the support sheet may be omitted.

The dye-receiving layer of the present invention preferably has a thickness of from 3 to 50 μm, more preferably from 3 to 20 μm, when the dye-receiving layer is provided on a support sheet, or preferably from 3 to 120 μm when a support sheet is omitted.

As described above, the dye-receiving layer in the heat transfer dye-receiving sheet serves to receive dyes which are transferred from a heat transfer sheet upon printing so that the dyes may function effectively. Specifically, the dye-receiving layer of the present invention is a film containing the following resins.

In the present invention, the dye-receiving layer contains a polyester resin comprising bisphenol A (2,2-bis(p-hydroxyphenyl)propane), carbonic acid and phthalic acid. Bisphenol A is present in the polyester resin in an amount equimolar with the total amount of carbonic acid and phthalic acid in the polyester resin.

The ratio of carbonic acid to phthalic acid is preferably adjusted to that the amount of carbonic acid is from 90 to 10 mol %, more preferably from 70 to 30 mol %, based on the total amount of the carbonic acid and the phthalic acid. Terephthalic acid or isophthalic acid is preferred as the phthalic acid. The average molecular weight of the polyester resin is preferably from about 10,000 to 150,000, more preferably from about 20,000 to 100,000.

The polyester resin used in the present invention can be produced by conventional methods as described, e.g., in *High Polymer Engineering, A Series of Monograph on the Science and Engineering of High Polymers,* vol. III, pages 432 to 433, published by Chijinshokan Co., Ltd., Japan (1968).

In addition to the above described polyester resin, silica fine particles may be included to form the dye-receiving layer.

Silica referred to herein means silicon dioxide or a substance mainly composed of silicon dioxide. Silica fine particles contained in the dye-receiving layer preferably have an average particle diameter of from about 10 to 100 μm, more preferably from about 10 to 50 μm, and a specific surface area of less than about 250 $m^2/g$.

The silica fine particles meeting the above requirements are commercially available, e.g., under tradenames such as "AEROSIL R 972", "AEROSIL 130", "AEROSIL 200", "AEROSIL OX50", "AEROSIL TT 600", "AEROSIL MOX80" and "AEROSIL MOX170" (made by Aerosil Co., Ltd.).

The content of silica fine particles is preferably in the range of from 5 to 20 wt %, more preferably from 5 to 10 wt % based on the weight of the dye-receiving layer.

These silica fine particles may be firstly added into resins which form the dye-receiving layer, and the resulting resin mixture (coating composition) may then be coated on a support and dried to form the dye-receiving layer.

A releasing agent may be included in the dye-receiving layer of the heat transfer dye-receiving sheet of the present invention to improve dye transfer sheet releasing properties from the dye-receiving sheet. Examples of the releasing agents include solid waxes such as polyethylene wax, amide wax or teflon powder; surface active agents such as fluorine type agents or phosphate type agents; and silicone oil. Among these, silicone oil is preferred.

Oily silicone oils can be used as the silicone oil, but hardenable silicone oil is preferred. The hardenable silicone oil can include silicone oil which can be hardened by a chemical reaction, silicone oil hardened by light and silicone oil hardened by catalyst. Among these, silicone oil hardened by a chemical reaction is particularly preferred. The chemical reaction hardenable silicone oil is preferably one where amino modified silicone oil and epoxy modified silicone oil are reacted and hardened. The amino modified silicone oil is commercially available under the tradenames of, e.g., "KF-393", "KF-857", "KF-858", "X-22-3680" and "X-22-38010" made by Shin-Etsu Chemical Co., Ltd. The epoxy modified silicone oil is commercially available under the tradenames of, e.g., "KF-100T", "KF-101", "KF-60-164" and "KF-103" made by Shin-Etsu Chemical Co., Ltd. The catalyst hardenable type silicone oil is commercially available under the tradenames of, e.g., "KS-705F" and "KS-770" made by Shin-Etsu Chemical Co., Ltd. and a light hardenable silicone oil is commercially available under the tradenames of, e.g., "KS-720" and "KS-774" made by Shin-Etsu Chemical Co., Ltd. The additive amount of these hardenable silicone oil is preferably from 0.5 to 30 wt %, more preferably from 1 to 10 wt %, based on the amount of the resins which is contained in the dye-receiving layer.

Color deterioration preventing agents and/or ultraviolet ray absorbing agents can be included in the coating composition for forming the dye-receiving layer by dispersing or dissolving, then coating the resulting coating composition and finally drying.

Examples of the color deterioration preventing agent which may be included in the dye-receiving layer include antioxidants such as hydroquinones, hindered phenols, comparing or a metal complex and an energy quencher.

Examples of the ultraviolet absorbing agents which may be included in the dye-receiving layer include benzotriazole, thiazolin and cinnamate type compounds.

Oil drops may be present in the dye-receiving layer of the present invention to improve slipping properties, adhesive resistance, peeling-off properties and curl balance.

In the present invention, the term oil drops means oily independent systems finely dispersed in a hydrophilic col oid and actually refers to water-insoluble liquid particles. The smaller the particle diameter is, the better the oil drop is. The particle diameter of the oil drops is preferably 3 μm or less, more preferably 1 μm or less, most preferably 0.5 μm or less.

In the present invention, oil drops are preferably an organic solvent having a high boiling point which is liquid at a normal temperature and does not evaporate at a heat processing temperature, such as esters (e.g., phthalates, phosphates and fatty acid esters), amides (e.g., fatty acid amides, sulfonamides), ethers, alcohols, paraffins or silicon oil, as disclosed, for example, in U.S. Pat. Nos. 2,322,027, 2,533,514, 2,882,157, JP-B No. 46-23233, British Patent Nos. 958,441, 1,222, 753, JP-A No. 50-82078, U.S. Pat. Nos. 2,353,262, 3,676,142, 2,600,454, JP-A Nos. 51-28921, 51-41623 and 62-9348. (The term "JP-A" as used herein means an "unexamined published Japanese patent application" and the term "JP-B" as used herein means an "examined Japanese patent publication".)

An intermediate layer may be provided between the support sheet and the dye-receiving layer.

Depending upon the construction materials, the intermediate layer may be a cushioning layer or a porous layer, and serves, in some cases, as an adhesive layer.

The cushioning layer is mainly composed of resins having a 100% modulus of 100% or less, as defined in JIS-K-6301. Resins meeting the above requirement include polyurethane resins, polyester resins, polybutadiene resins, polyacrylic acid ester resins, epoxy resins, polyamide resins, rosin modified phenol resins, terpene phenol resins and resins of copolymers of ethylene and vinyl acetate. The above resins may be used alone or in mixture.

A porous layer can be prepared by (1) foaming an emulsion of synthetic resins such as polyurethane or synthetic rubber latex such as methyl methacrylate-butadiene type with mechanical stirring, coating it on a support sheet and drying, (2) coating the mixture of the above synthetic resin emulsion or the above synthetic rubber latex with a foaming agent on a support sheet and drying, (3) coating the mixture of synthetic resins such as vinyl chloride plastisol or polyurethane or synthetic rubber such as styrene-butadiene type and a foaming agent on a support sheet and heating to foam the mixed composition, and (4) coating a mixture of a solution having dissolved thermoplastic resins or synthetic rubber in an organic solvent and a non-solvent (including a non-solvent mainly composed of water) which has a lower vapor pressure than the above organic solvent, is miscible with the above organic solvent and does not dissolve the termoplastic resins nor synthetic rubber, on a support sheet and drying to obtain a microporous layer.

When the dye-receiving layer is present on both sides of the support sheet, the above described intermediate layer may be provided on one or both surfaces of the support sheet. The intermediate layer has a thickness of preferably from 0.5 to 50 μm, particularly preferably from 2 to 20 μm.

An antistatic agent may be included in or coated on the at least one dye-receiving layer(s) of the heat transfer dye-receiving sheet of the present invention. Examples of the antistatic agents include surface active agents such as cationic surface active agents (e.g., a quaternary ammonium salt, a polymine derivative), anionic surface active agents (e.g., an alkylphosphate), amphoteric ionic surface active agents or nonionic surface active agents.

A method for providing the dye-receiving layer either on or without a support sheet and solvents and additives used therefor may be those described, e.g., in JP-A Nos. 62-202791, 61-32387 and 62-52793.

The heat transfer dye-receiving sheet of the present invention is used in combination with a heat transfer sheet.

In a first embodiment of the present invention, the heat transfer layer of a heat transfer sheet is a heat-sensitive sublimation type transfer layer comprising a heat-sublimable transfer dye and a binder resin. The heat transfer sheet of the above embodiment is obtained by dissolving or dispersing the conventional heat-transfer dye, i.e., a dye transferable by sublimation, and a binder resin in a proper solvent to provide a coating composition, and coating the coating composition on at least one surface of a support sheet to provide a conventional heat transfer sheet at a coated dry thickness of, for example, from about 0.2 to 5.0 μm, followed by drying.

The dyes effective for forming a heat-sensitive sublimation transfer layer include those conventionally used for a heat-sensitive sublimation transfer recording sheet. Particularly preferred dyes include those having a low molecular weight of from about 150 to 600, and are selected taking account of the sublimation temperature, the color phase, the light-fastness, the solubility and the dispersibility in an ink and a binder resin. Specifically, these dyes include disperse dyes, basic dyes and oil-soluble dyes, and are preferably "Sumikaron Yellow - E4GL" and "Sumikaron Red EFBL" (a tradename of Sumitomo Chemical Co., Ltd.), "Dianix Yellow-H2G-FS" and "Dianix Red ACE" (a tradename of Mitsubishi Chemical Industries, Ltd.), "Kayaset Yellow-937", "Kayaset Blue-136" and "Kayaset Red 126" (a tradename of Nippon Kayaku Co., Ltd.), and "Miketon First Brillian blue-B", "Miketon Polyester Red FB", "Miketon polyester Yellow-3GSL", "Miketon Polyester Red FB", "Miketon polyester Yellow-3GSL" and "Miketon polyester Yellow-3GSL" (a tradename of Mitsui Petrochemical Industries, Ltd.). Preferred examples of the sublimable yellow dyes include those disclosed in JP-A Nos. 59-78895, 60-28451, 60-28453, 60-53564, 61-48096, 60-239290, 60-31565, 60-30393, 60-53565, 60-27594, 61-26219, 60-52563, 61-244595 and 62-196186.

Preferred examples of the sublimable magenta dyes include those disclosed in JP-A Nos. 60-223862, 60-28452, 60-31563, 59-78896, 60-31564, 60-30391, 61-227092, 61-22709, 60-30392, 60-30394, 60-131293, 61-227093, 159091, 61-262190, U.S. Pat. No. 4,698,651 and Japanese Patent Application No. 62-220793 which is represented by the following formula:

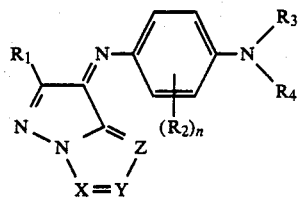

Preferred examples of the sublimable cyan dyes include those disclosed in JP-A Nos. 59-78894, 59-227490, 60-151098, 59-227493, 61-244594, 59-227948, 60-131292, 60-172591, 60-151097, 60-131294, 60-217266, 31559, 60-53563, 61-255897, 60-239289, 61-22993, 61-19396, 61-268493, 61-35994, 61-31467, 61-148269, 61-49893, 61-57651, 60-23929, 60-239292, 61-284489, 62-191191 and Japanese Patent Application No. 62-176625 which is represented by the following formula:

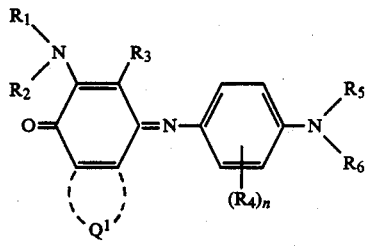

As the binder resins which are used with the above dyes in the present invention, any of binder resins which are conventionally used for these purpose can be used. In general, a binder resin which has a high heat resistance and does not hinder the transfer of the dye at heating is selected. Examples of the binder resin include polyamide type resins, polyester type resins, epoxy resins, polyurethane type resins, polyacryl type resins (e.g., polymethyl methacrylate, polyacrylamide, polystyrene-2acrylonitrile), vinyl type resins such as polyvinylpyrrolidone, polyvinyl chloride type resins (e.g., a vinyl chloride-vinyl acetate copolymer), polycarbonate type resins, polysulfons, polyphenyleneoxides, cellulose type resins (e.g., methyl cellulose, ethyl cellulose, carboxymethyl cellulose, cellulose acetate hydrogen phthalate, cellulose acetate, cellulose acetate butyrate, cellulose triacetate), polyvinyl alcohol type resins (e.g., polyvinyl alcohol and partially saponified polyvinyl alcohol such as polyvinyl butyral), petroleum type resins, rosin derivatives, coumarone-indene resins, terpene type resins, novolak type phenol resins, polystyrene type resins and polyolefin type resins (e.g., polyethylene, polypropylene).

It is preferred that the binder resin is used in an amount of from about 80 to 600 parts by weight per 100 parts by weight of the dye.

As an ink solvent for dissolving or dispersing the above dyes and binder resins, those which are conventionally used for this purpose can be used. Specific examples thereof include alcohol type solvents such as methanol, ethanol, isopropyl alcohol, butanol or isobutanol, ketone type solvents such as methyl ethyl ketone, methyl isobutyl ketone or microhexanone, aromatic solvents such as toluene or xylene, halogen type solvents such as dichloromethane, or trichloroethane, dioxane, and tetrahydrofuran. They may be used singly or as a mixture thereof.

It is important to select the solvent which can dissolve the dye at a concentration of higher than a definite value and can sufficiently dissolve or disperse the above binder resin. For example, it is preferred to use the solvent in an amount of from about 9 to 20 times the total weight of the above dye and binder resin.

The heat transfer sheet in the first preferred embodiment of the present invention is superimposed on the heat transfer dye-receiving sheet of the present invention and the heat transfer sheet is heated from any sides of the assemblage, preferably from the heat transfer sheet side, by a heating means such as a thermal head according to image signals, whereby the dye in the heat transfer layer is transferred onto the dye-receiving layer of the heat transfer dye receiving sheet according to the extent of the heating energy, to form color images having excellent sharpness and resolving power.

In a second preferred embodiment of the present invention, a heat transfer layer of the heat transfer sheet is a heat-sensitive melt transfer layer comprising a dye or a pigment and a wax. The heat transfer sheet of the present embodiment is obtained by preparing an ink for forming the heat transfer layer comprising the wax containing coloring agents such as dyes or pigments, and forming a heat-sensitive melt transfer layer on one surface of a support as described above using the ink. The ink is prepared by dispersing carbon black or various coloring agents such as dyes or pigments in a wax such as paraffin wax, microcrystalline wax, carnauba wax, or urethane type wax, which functions as a binder. The amount ratio of the dye or the pigment is preferably from about 10 to 65 wt % in the thus formed heat-sensitive melt transfer layer. The thickness of the layer is preferably in the range of from about 1.5 to 6.0 μm. The preparation and the application thereof on a support can be performed according to known techniques.

Examples of the support used in the heat transfer sheet of the first and the second embodiments include poly(ethylene terephthalate); polyamide; polycarbonate; glassine paper; condenser paper; cellulose ester; fluorinated polymer; polyether; polyacetal; polyolefin; and polyphenylene sulfide, polypropylene, polysulfon, cellophane and polyimide, having a thickness of generally from 2 to 30 μm. If necessary, an under coating layer may be provided on the support.

A dye barrier layer comprising a hydrophilic polymer may be provided between the support and the dye-containing layer of the heat transfer sheet, whereby the concentration of the transferred dye can be improved.

A slipping layer can be provided on the dye-receiving sheet of the present invention so as to prevent a print head from sticking on the dye-containing layer. The slipping layer comprises a lubricating substance, such as surface active agents, liquid lubricating agents, or solid lubricating agents, containing or not containing polymer binders which may be used singly or in mixture.

The heat transfer dye-receiving sheet of the present invention contains polyester resins comprising bisphenol A, carbonic acid and phthalic acid in the dye receiving layer, and therefore recording can clearly be made from the transferred dyes. Also, the recorded images have excellent durability.

The present invention will be described in more detail referring to the following Examples and Comparative Examples, but is not construed as being limited thereto. Unless otherwise indicated, all parts, ratios, percents, etc. are by weight.

EXAMPLE 1

Preparation of a heat transfer sheet (A)

A polyethylene terephthalate film having a thickness of 6 μm of which the surface had been corona discharge-treated ("S-PET" made by TOYOBO CO., LTD.) was used as a support, and the coating composition (A) having the following formulation for the heat transfer layer was coated on the corona treated surface using a wire bar to a dry thickness of 1 μm. On the opposite surface to the corona treated surface, a slipping layer comprising polyvinyl butyral ("Butopal-76" made by Monsanto Co., Ltd.) (0.45 g/m$^2$) and poly(vinyl stearate (0.3 g/m$^2$) by using tetrahydrofuran as a solvent for coating.

Coating composition or heat transfer layer (A)

| | |
|---|---|
| Cyan dye (a) | 4 g |
| Polyvinyl butyral resin ("Denkabutyral 500-A" made by DENKI KAGAKU KOGYO KABUSHIKI KAISHA) | 4 g |
| Toluene | 40 ml |
| Methyl ethyl ketone | 40 ml |
| Polyisocyanate ("Takenate $D_{11}ON$" made by Takeda Chemical Industries, Ltd.) | 0.2 ml |

Cyan dye (a)

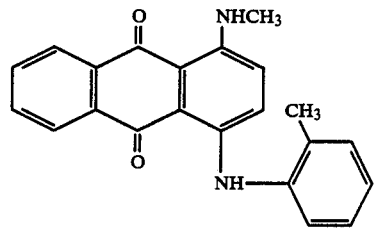

Preparation of a heat transfer dye-receiving sheet

On a synthetic paper having a thickness of 150 μm ("YUPO-FPG-150" made by Oji Yuka Co., Ltd.), the coating composition for a dye-receiving layer having the following formulation was coated by a wire bar coating method to a dry thickness of 10 μm to obtain a heat transfer dye-receiving sheet (1). It was then dried preliminarily with an air dryer, and was dried in an oven at 100° C. for 30 minutes.

Coating composition for dye-receiving layer (1)

| | |
|---|---|
| Polyester resin ("APEC KLI-9306" made by Bayer Co., Ltd., carbonic acid: 70 mol %, phthalic acid: 30 mol %, molecular weight: about 17,000) | 20 g |
| Amino modified silicone oil ("KF-857" made by Shin-Etsu Silicon Co., Ltd.) | 0.5 g |
| Epoxy modified silicone oil ("KF-100T" made by Shin-Etsu Silicon Co., Ltd.) | 0.5 g |
| Dibutyl phthalate | 2 ml |
| Methyl ethyl ketone | 85 ml |
| Toluene | 85 ml |
| Cyclohexanone | 30 ml |

The heat transfer dye-receiving sheets of the present invention (2) to (6) were prepared in the same manner as above except that the polyester resins having compositions shown in Table 1 were used instead of the polyester resin in the heat transfer dye-receiving sheet (1), and the heat transfer dye-receiving sheet for comparison (a) was prepared in the same manner as above except that a polyethylene terephthalate resin was used instead of the polyester resin in the heat transfer dye-receiving sheet (1).

The molecuar weights of the resins used in the dye-receiving sheets (2) to (6) and (a) were 17,000, 17,000, 25,000, 25,000, 33,000 and 20,000, respectively.

The heat transfer sheet prepared above was superposed on the dye-receiving sheet thus obtained so that the dye-containing layer and the dye-receiving layer were in contact therewith. Printing was carried out from the support side of the heat transfer sheet by a thermal head under the conditions of 1 W/dot in the output of the thermal head, 0.3 to 0.45 msec. in pulse width and 3 dots/mm in dot density, whereby transferred clear images without unevenness were obtained.

The thus recorded heat transfer dye-receiving sheet was exposed to a fluorescent lamp of 15,000 lux for 14 days to investigate the stability of the color images. Another recorded sheet also allowed to stand in an incubator at 60° C. for 14 days to investigate the heat-resistance of the image. The status A reflection densities before and after the test were measured and the image stability was evaluated in terms of the percent ratio of the densities before and after the test. The results are shown in Table 1.

TABLE 1

| Heat transfer image-receiving sheet | Mol % of carbonic acid* | Phthalic acid | Image density immediately after recording | Image stability: Fluorescent lamp exposure | Image stability: Storage at 60° C. |
|---|---|---|---|---|---|
| (1) | 70 | Isophathalic acid | 1.20 | 87 | 96 |
| (2) | 50 | Isophathalic acid | 1.15 | 85 | 93 |
| (3) | 30 | Iso phathalic acid | 1.12 | 90 | 92 |
| (4) | 70 | Terephthalic acid | 1.18 | 86 | 94 |
| (5) | 50 | Terephthalic acid | 1.15 | 84 | 91 |
| (6) | 93 | Isophthalic acid | 1.05 | 82 | 85 |
| (b) | (Polyethylene terephthalate) | | 1.07 | 80 | 88 |

*The amount of carbonic acid is represented in terms of mol % based on the total amount of carbonic acid and phthalic acid.

EXAMPLE 2

Heat transfer sheets (B) and (C) were prepared in the same manner as in the preparation of the heat transfer sheet (A) in Example 1 except that the dye contained in the layer was replaced with the following magenta dye (b) or yellow dye (c), and printing was carried out in the same manner as in Example 1 by using the heat transfer dye-receiving sheets used in Example 1, and clear images were obtained. The stability of color images was evaluated in the same manner as in Example 1. The results are show in Table 2.

Magenta dye (b)

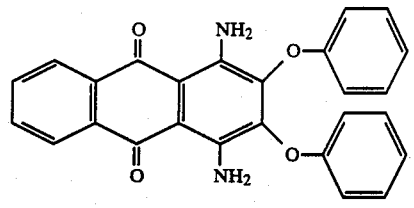

Yellow dye (c)

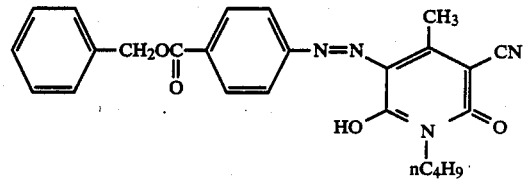

TABLE 2

| Heat transfer sheet | Heat transfer dye-receiving sheet | Image density immediately after recording | Image stability: Fluorescent lamp exposure | Image stability: Storage at 60° C. |
|---|---|---|---|---|
| (B) | (1) | 1.10 | 94 | 95 |
| (B) | (2) | 1.07 | 96 | 96 |
| (B) | (5) | 0.98 | 95 | 97 |
| (B) | (6) | 0.90 | 92 | 93 |
| (B) | (a) | 0.95 | 90 | 90 |
| (C) | (1) | 1.05 | 78 | 96 |
| (C) | (3) | 1.01 | 80 | 98 |
| (C) | (4) | 1.03 | 76 | 97 |
| (C) | (6) | 0.95 | 70 | 94 |
| (C) | (a) | 0.98 | 65 | 92 |

EXAMPLE 3

Preparation of a heat transfer sheet (D)

A coating composition for a slipping and heatresistant protective layer was prepared by sufficiently mixing and dispersing the following composition.

Coating composition for protective layer

Methyl methacrylate: 10 g
n-Butylacrylate 2 g
Benzoyl peroxide: 0.1 g
Silica: 2.5 g
Toluene: 35 g
Isopropyl alcohol: 15 g The coating composition was diluted appropriately by adding a mixed solution of toluene and Isopropyl alcohol thereto and was coated by a wire bar on a polyethylene terephthalate film having a thickness of 6 μm as a support, and was dried at 100° C. for 1 min. to obtain a slipping heat-resistant protective layer having a thickness of about 1.5 μm.

Then, the heat-melt and fusible ink having the following composition was coated on the support on the opposite surface to the side having the protective layer.

Composition of the heat-melt and fusible ink

Neozavon blue—807 (dye) (made by BASF): 10 g
Barium lanolinate: 30 g
Carnauba wax: 20 g
Paraffin wax: 20 g Dispersing agent: 0.5 g Liquid paraffin: 5 g The ink having the above composition was sufficiently dispersed in a mixture of 100 ml of methyl ethyl ketone and 130 ml of toluene at 68° C. in a ball mill for about 48 hours.

Then, 300 g of 20 wt % solution of vinyl chloride and vinyl acetate copolymer resin (10 parts of resin, 20 parts of toluene and 20 parts of methyl ethyl ketone) was added to the aforesaid ink dispersion and dispersed in a ball mill for about 1 hour to prepare a coating composition for a heat transfer sheet.

The thus obtained coating composition was coated using a wire bar on a surface of the aforesaid polyester film provided with the slipping heat-resistant layer and was dried at 100° C. for 1 min. to form a heat melt and fusible ink layer having a dry thickness of about 5 μm.

Using the thus obtained heat melt and fusible transfer sheet and the heat transfer dye-receiving sheets of Example 1, recording was carried out and the density of color images and the image stability were evaluated in the same manner as in Example 1. The results are shown in Table 3.

TABLE 3

| Heat transfer dye-receiving sheet | Image density immediately after recording | Image stability | |
|---|---|---|---|
| | | Fluorescent lamp exposure | Storage at 60° C. |
| (1) | 1.50 | 75 | 94 |
| (3) | 1.60 | 78 | 96 |
| (4) | 1.55 | 76 | 95 |
| (6) | 1.40 | 71 | 92 |
| (a) | 1.43 | 65 | 90 |

It is understood from the results obtained in the aforesaid Examples that the uniformly transferred clear images can be obtained and the durability of the images is also excellent by using a heat transfer dye-receiving sheet having a dye-receiving layer which contains polyester resin according to the present invention.

While the invention has been described in detail and with reference to specific examples thereof, it will be apparent to one skilled in the art that various changes and modifications can be made therein without departing from the spirit and scope thereof.

What is claimed is:

1. A heat transfer dye-receiving sheet used in combination with a heat transfer sheet having a dye carrying layer containing a dye, said heat transfer dye-receiving sheet comprising a dye-receiving layer capable of receiving sheet comprising a support and a dye-receiving layer capable of receiving said dye transferred from said heat transfer sheet, wherein said dye-receiving layer contains a polyester resin comprising bisphenol A, carbonic acid and phthalic acid.

2. A heat transfer dye-receiving sheet as claimed in claim 1, wherein said dye-receiving layer has a thickness of from 3 to 50 μm.

3. A heat transfer dye-receiving sheet as claimed in claim 1, wherein the content of carbonic acid is from 90 to 10 mol % based on the total amount of carbonic acid and phthalic acid.

4. A heat transfer dye-receiving sheet as claimed in claim 3, wherein the content of carbonic acid is from 70 to 30 mol % based on the total amount of carbonic acid and phthalic acid.

5. A heat transfer dye-receiving sheet as claimed in claim 1, wherein said polyester resin has a weight average molecular weight of from about 10,000 to 150,000.

6. A heat transfer dye-receiving sheet as claimed in claim 5, wherein said polyester resin has a weight average molecular weight of from 20,000 to 100,000.

7. A heat transfer dye-receiving sheet as claimed in claim 1, wherein said dye-receiving layer contains silica in an amount of from 5 to 20 wt % based on the amount of said dye-receiving layer.

8. A heat transfer dye-receiving sheet as claimed in claim 1, wherein said dye-receiving layer contains silicone oil in an amount of from 0.5 to 30 wt % based on the total amount of the resin contained in said dye-receiving layer.

9. A heat transfer dye-receiving sheet as claimed in claim 1, wherein said dye-receiving sheet comprises a sheet-shaped support having provided on the surface thereof said dye-receiving layer.

10. A heat transfer dye-receiving sheet as claimed in claim 1, wherein said bisphenol A is present in said polyester resin in an amount equimolar with the total amount of carbonic acid and phthalic acid in the polyester resin.

* * * * *